United States Patent [19]

Koizumi

[11] Patent Number: 4,562,376

[45] Date of Patent: Dec. 31, 1985

[54] LIGHT SOURCE FOR PRODUCING ATOMIC SPECTRAL LINE

[75] Inventor: Hideaki Koizumi, Tokyo, Japan

[73] Assignee: Hitachi, Ltd., Tokyo, Japan

[21] Appl. No.: 513,316

[22] Filed: Jul. 13, 1983

[30] Foreign Application Priority Data

Jul. 19, 1982 [JP] Japan ..... 57-124456

[51] Int. Cl.[4] ..... H01J 61/09; H01J 61/52

[52] U.S. Cl. ..... 313/34; 313/40; 313/618

[58] Field of Search ..... 313/40, 34, 618

[56] References Cited

U.S. PATENT DOCUMENTS

| | | | |
|---|---|---|---|
| 1,954,958 | 4/1934 | Smythe | 313/618 X |
| 2,629,836 | 2/1953 | Deri | 313/618 X |
| 3,205,388 | 9/1965 | De Lany et al. | 313/40 X |
| 3,401,292 | 9/1968 | Cirri | 313/618 X |
| 3,405,299 | 10/1968 | Hall et al. | 313/34 X |
| 3,605,074 | 9/1971 | Freggens | 313/34 X |

OTHER PUBLICATIONS

"Evaluation of New High Frequency Discharge Lamps for Atomic Absorption . . . ," by K. Tsujii et al., *Analytica Chimica Acta,* 111, 1979, pp. 103–109.

*Primary Examiner*—Palmer C. DeMeo

*Attorney, Agent, or Firm*—Antonelli, Terry & Wands

[57] ABSTRACT

Disclosed is a light source having an envelope containing therein an anode and a hollow cathode, in which the hollow cathode is supported by a hollow metal cylinder. The hollow cylinder externally extends out of the envelope and a plurality of radiation fins are attached on the outer wall of the externally extending portion of the cylinder. Meshes are provided on the inner wall of the hollow chamber of the cylinder. Water is sealed in the hollow chamber under a reduced pressure to facilitate evaporation. The condensed water is displaced toward a high temperature portion by capillarity. The water is evaporated at the high temperature portion while taking away the latent heat of evaporation. In such an arrangement, the cathode is maintained at a low temperature so that the self-absorption of the spectral line can be reduced.

13 Claims, 6 Drawing Figures

LIGHT SOURCE FOR PRODUCING ATOMIC SPECTRAL LINE

BACKGROUND OF THE INVENTION

The present invention relates to a light source for producing an atomic spectral line and particularly to an improved light source provided therein with a hollow cathode.

For the atomic absorption analysis, required is a light source for producing an atomic spectral line having a very narrow line width. A usually used light source produces a spectral line of half width of several GHz (about 2–20 mÅ). There has occurred a problem in the conventional light source that a spectral line having a small half width can not be obtained in the case of metal such as Cd, Zn, which is relatively high in vapor pressure and large in oscillator strength (f value) of a resonance line. That is, there may occur a so-called self-absorption phenomenon that the metal vapor excessively generated in the light source absorbs part of emitted light so that the emission line shape lacks its central peak portion, thereby making the half width extremely large. The temperature of the conventional hollow cathode may arise to about 250°–350° C. Low melting point materials may vaporize at such a high temperature and cause self absorption. In the basic research, it has been proposed to cool the light source to suppress the self-absorption phenomenon to thereby obtain a shape emission line of a narrow half width. For example, in Analytica Chimica Acta, 111 (1979), pp. 103–109, K. Tsujii et al. suggest an example in which a double-walled glass tube, through which cooling water is caused to flow, is provided around a hollow electrode in a lamp. Most of metals, except Hg, have only negligibly small vapor pressure below 100° C.

In a practical device, however, it is difficult to realize cooling a lamp by water. That is, not only troublesome piping is required for cooling but also in some cases it is necessary to apply a high potential such as several hundred volts to a cathode which has to be cooled strongly, resulting in incapability of assurance of safety. Further, since it is necessary to replace the light source for each element which is to be analyzed in atomic spectral analysis, there arises a problem that it is required to perform piping operation for the cooling pipes every time the element to be analyzed is changed, in the case where water cooling is performed. It is difficult to replace the light source without allowing a drop of cooling water to escape, thereby causing a problem in the optical system having poor reliability against humidity as well as causing a risk of electric shock because of a high voltage of several hundred volts usually applied in the vicinity of the light source.

SUMMARY OF THE INVENTION

An object of the present invention is to provide a light source in which an atomic spectral line of a narrow line width can be obtained.

Another object of the present invention is to provide a light source in which heat generated at the atomic vapor producing portion can be efficiently discharged without performing water cooling.

A further object of the present invention is to provide a light source in which an emission spectral line of little self-absorption can be obtained.

According to the present invention, a thermally conductive member is connected to a hollow cathode contained in an envelope and externally extended so as to be cooled by air to thereby maintain the temperature of the atomic vapor producing portion at a low value.

DESCRIPTION OF THE PREFERRED EMBODIMENTS

Figure 1:
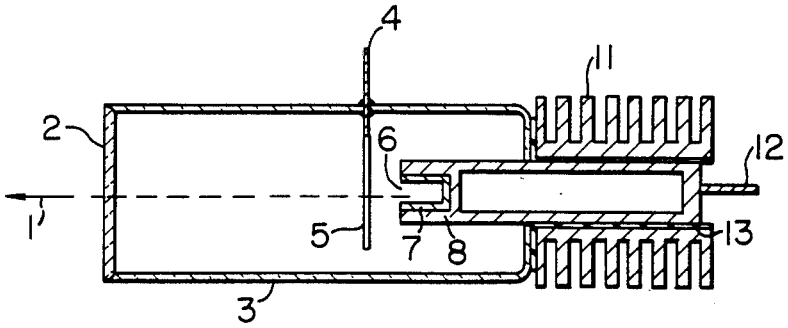
FIG. 1 is a schematic sectional view of a light source according to an embodiment of the present invention.
Figure 2:
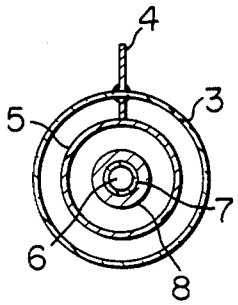
FIG. 2 is a front view of the embodiment of FIG. 1.

Referring to FIGS. 1 and 2, an embodiment of the present invention will be now described. A window 2 made of quartz is provided at an end of a glass envelope 3, and a hollow cathode 7 and a ring-shaped anode 5 are arranged in the envelope. The hollow cathode 7 having a hole 6 is produced by shaping, e.g. a metal cadmium (Cd) material. The hollow cathode 7 is positioned along the central axis of the envelope and supported by a metal cylinder 8 at its one end, the other end of which cylinder 8 externally extends out of the envelope 3. The metal cylinder 8 is made of a material, such as copper (Cu), having a good thermal conductivity. The inside of the envelope 3 containing the hollow cathode 7 and the anode 5 is filled with an inert gas such as Ne or Ar and the pressure thereat is selected to be about 1 to 5 Torr. Cooling fins 11 are attached, through an electrically insulating thin film 13, around the metal cylinder 8 at its portion externally extending out of the glass envelope 3. The electrically insulating thin film 13 is made of a thermally conductive and heat-resistive material such as ethylene tetrafluoride. The cooling fins 11 are made of a material, such as copper or aluminum, having good thermal conductivity. Lead wires 4 and 12 are connected to the anode 5 and the hollow cylinder 8 respectively.

Upon the application of voltage across the cathode 7 and the anode 5 through the lead wires 4 and 12 in the thus arranged light source, glow discharge is generated so that the cathode material is sputtered and excited, resulting in luminescence of atomic spectral lines peculiar to the cathode material so as to emit an output light 1 out of a window 2. At this time, the heat generated at the hollow cathode 7 is transmitted to the metal cylinder 8 and reaches the cooling fins 11 provided at the metal cylinder portion externally extending out of the glass envelope 3, so that the heat is dissipated in the atmosphere. Therefore, the heat is not accumulated in the hollow cathode 7 and the hollow cathode 7 can be maintained at a low temperature.

Figure 3:
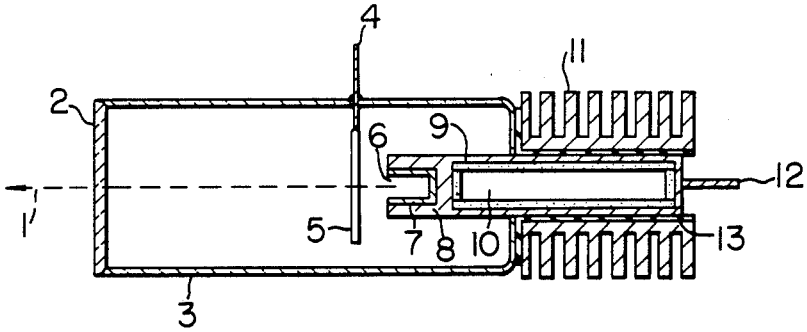
FIG. 3 is a schematic sectional view of a light source according to another embodiment of the present invention.

FIG. 3 shows a configuration of another embodiment of the atomic spectral light source according to the present invention. The parts having the similar function as those in FIG. 1 are designated by the similar reference numerals as those used in FIG. 1. The metal cylinder 8 has a hollow chamber 10 extending from the neighborhood of the hollow cathode 7 through the outer end surface of the envelope 3. The inner wall of the hollow chamber 10 is entirely covered with a porous material 9 and the pressure inside the hollow chamber is reduced. The cylinder 8 constitutes a heat pipe. The hollow chamber 10 seals a volatile liquid of large latent heat of evaporation, for example, water, so that 100–500 Torr of vapor pressure can be obtained in operation of the lamp. Methyl alcohol, ethyl alcohol, ammonia, etc. may also be used. The porous material 9 is constituted by a net of stainless steel, a cylinder made of sintered metal, a cylinder made of ceramics, or the like and attached to the inner wall of the hollow chamber 10 so as to be in contact with the entire surface of the same. The porous material 9 has a characteristic to provide capillarity. The thickness of the porous material may be selected to transfer sufficient liquid by the capillary action and yet to leave a sufficient vacant space to achieve sufficient transport of vapor. For example, the thickness may be 1 to 2 mm.

When the hollow cathode 7 is heated by the discharge in this arrangement, the heat is immediately transmitted to the metal cylinder 8. Since the pressure in the hollow chamber 10 in the metal cylinder 8 is normally reduced so as to facilitate the evaporation of the liquid held by the porous material 9, the wall of the hollow chamber 10 at the hollow cathode side (hereinafter referred to as high temperature side) is heated by the heat generated by the hollow cathode 7. The liquid held at the high temperature side by the porous material 9 is evaporated so that a large amount of evaporation heat is taken away to thereby reduce the temperature of the portion of metal cylinder 8 in the vicinity of the hollow cathode. For example, the boiling point of water is about 65° C. at 100 Torr and about 90° C. at 500 Torr. Thus, when the pressure inside the chamber 10 is 100 Torr, the water boils and takes the latent heat away from the hot end when the hot end is at 65° C. The vapor generated in the hollow chamber 10 at the high temperature side immediately diffuses to and condenses at the side to give the heat of condensation, at which side the cooling fins are provided (hereinafter referred to as low temperature side), and is absorbed by the porous material 9. The thus absorbed liquid at the low temperature side of the porous material 9 is moved to the high temperature side of the same porous material 9 by capillarity. The process to transfer heat from the high temperature side to the low temperature side is repeated so that the temperature of the hollow cathode 7 is maintained close to the temperature of the cooling fins 11.

Figure 4:
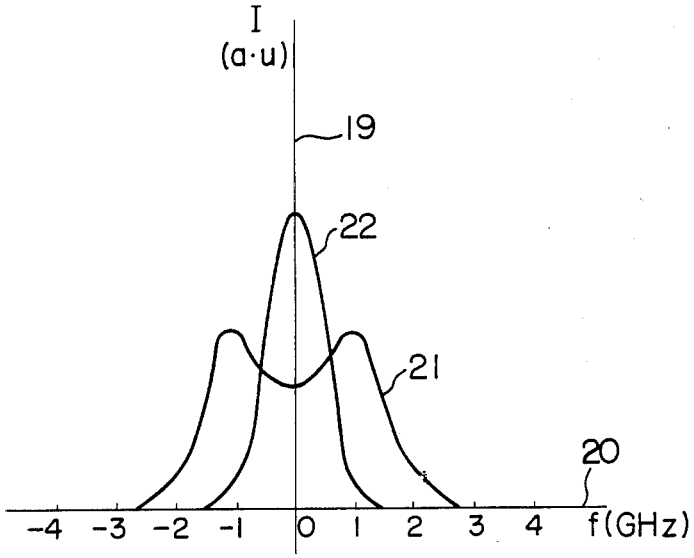
FIG. 4 is a graph for explaining the profile of an emission spectral line.

It has been found that the relation between the light intensity of emitted spectral line and the frequency obtained in the atomic spectral light source are as shown in FIG. 4 in which the relation is compared with that obtained by the conventional light source. In FIG. 4, the ordinate 19 represents the intensity of light and the abscissa 20 represents the width of spectral line. It is understood, as seen in the drawing, that self-reversal in the case of the resonance absorption line of 228.8 nm of Cd is much improved in comparison with the conventional light source which is set at the same intensity. That is, while the intensity profile 21 of the luminous line obtained by using the conventional hollow cathode lamp drops at the central portion of the spectral line due to the self-absorption, the luminous profile 22 obtained by the light source according to the embodiment does not exhibits such self-reversal but shows a so-called Gaussian profile. It is expected that the light source of FIG. 1 can emit similar line spectrum when the hollow cathode is maintained below about 100° C.

Figure 5A:
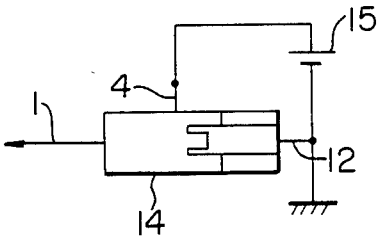
FIGS. 5*a* and 5*b* are examples of power supply to the light source.
Figure 5B:
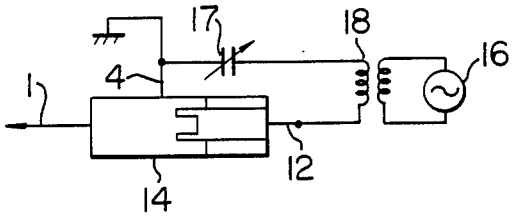

FIGS. 5*a* and 5*b* illustrate the modes of driving the light source for producing atomic spectral lines, in which FIG. 5*a* shows an example of a method of supplying electric power from a DC source 15 and FIG. 5*b* shows an example of a method of supplying electric power from a high frequency source 16 through a coupling coil 18 and a variable capacitor 17.

As described above, an atomic spectral line which has a narrow line width and which is easy to handle in practical use can be obtained by employing the atomic spectral light source according to the present invention.

I claim:

1. A light source having an envelope containing therein an anode and a hollow cathode, for producing an atomic spectral line, comprising:

a thermally conductive member connected to said hollow cathode and externally extending out of said envelope, said thermally conductive member being formed with a hollow chamber; and radiation fins provided on the externally extending portion of said thermally conductive member through an electrically insulating layer.

2. A light source according to claim 1, in which said hollow chamber contains a volatile liquid and has reduced pressure.

3. A light source according to claim 1, further comprising:

a member for producing capillarity provided on a wall of said hollow chamber.

4. A light source according to claim 1, in which said hollow cathode is supported by said thermally conductive member.

5. A light source according to claim 1, wherein said radiation fins are cooling fins.

6. A light source for producing atomic spectral lines, comprising:

a glass envelope having a light output window:

a hollow cathode disposed within said glass envelope and containing a material for producing atomic spectral lines;

an anode disposed within said glass envelope between said hollow cathode and said light output window;

support means for supporting said hollow cathode, said support means extending from the interior of said glass envelope to the exterior thereof, said support means having a sealed hollow chamber formed therein and extending from the interior to the exterior of said glass envelope, one end of said hollow chamber being located proximate to said hollow cathode;

a volatile liquid sealed in said hollow chamber;

a capillary member disposed on the inner wall of said hollow chamber to provide capillarity; and cooling fins disposed on a portion of said support means which extends outside said glass envelope.

7. A light source according to claim 6, wherein said capillary member is formed of at least one of a metal net, a sintered metal, and a ceramic material.

8. A light source according to claim 6, wherein said volatile liquid is at least one of water, methyl alcohol, ethyl alcohol and ammonia.

9. A light source according to claim 6, wherein said sealed hollow chamber is maintained at a reduced pressure.

10. A light source according to claim 6, wherein said glass envelope contains an inert gas.

11. A light source according to claim 6, further comprising an insulating layer disposed between said cooling fins and said support means.

12. A light source according to claim 11, wherein said cooling fins are formed of a metal having good thermal conductivity.

13. A hollow cathode discharge tube for producing spectral lines, comprising:

an envelope having a light output window and sealing an inert gas;

a thermally and electrically conductive member extending through said envelope at a portion opposite to said output window and having one end located within said envelope and the other end located outside and away from said envelope, said conductive member forming a cathode support and delimiting a sealed hollow chamber having one end located proximate to said one end of the conductive member and the other end located outside and away from said envelope;

a hollow cathode accommodated at said one end of said conductive member within said envelope;

an anode disposed within said envelope between said hollow cathode and said output window;

a capillary member covering the entire area of the inner wall of said hollow chamber;

a volatile liquid sealed in said sealed hollow chamber, said volatile liquid being retained by said capillary member; and means for cooling said conductive member including said one end of said sealed hollow chamber outside said envelope.

* * * * *